US006264448B1

(12) United States Patent
Itoh et al.

(10) Patent No.: US 6,264,448 B1
(45) Date of Patent: Jul. 24, 2001

(54) OPEN TYPE COMPRESSOR

(75) Inventors: Takahide Itoh; Makoto Takeuchi, both of Nagoya; Tetsuzou Ukai, Nishi-kasugai-gun, all of (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/588,731

(22) Filed: Jun. 7, 2000

(30) Foreign Application Priority Data

Jun. 8, 1999 (JP) ..... 11-161694

(51) Int. Cl.[7] ..... F01C 19/00

(52) U.S. Cl. ..... 418/104; 418/55.4; 418/55.6; 418/141; 418/DIG. 1; 418/100; 184/6.16

(58) Field of Search ..... 418/55.4, 55.6, 418/141, 104, DIG. 1, 100; 184/6.16

(56) References Cited

U.S. PATENT DOCUMENTS

| | | | | |
|---|---|---|---|---|
| 4,345,886 | * | 8/1982 | Nakayama et al. | 418/141 |
| 4,484,869 | * | 11/1984 | Nakayama et al. | 418/86 |
| 4,648,814 | * | 3/1987 | Shiibayashi | 418/55.6 |
| 4,834,634 | * | 5/1989 | Ono | 418/100 |
| 5,049,041 | * | 9/1991 | Nakajima | 418/100 |
| 5,464,163 | * | 11/1995 | Zoz | 241/172 |
| 5,567,137 | * | 10/1996 | Nakashima et al. | 418/55.4 |
| 6,074,187 | * | 6/2000 | Kawada et al. | 418/55.6 |

FOREIGN PATENT DOCUMENTS

| | | | | |
|---|---|---|---|---|
| 1570266 | * | 4/1978 | (GB) | 418/55.6 |
| 57-176382 | * | 10/1982 | (JP) | 418/100 |
| 3-006350 | | 1/1991 | (JP) . | |
| 5-172068 | * | 7/1993 | (JP) | 418/55.6 |
| 7-167068 | * | 7/1995 | (JP) | 418/55.6 |
| 7-043490 | | 10/1995 | (JP) . | |
| 11-241691 | * | 9/1999 | (JP) | 418/55.5 |

OTHER PUBLICATIONS

Corona Co., "Revised Refrigerating Engineering", pp. 141 to 148, Jul. 20, 1975 (with partial English Translation).

* cited by examiner

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

This compressor 1 is for compressing an introduced working gas to a predetermined pressure and exhausting by means of the rotation of a crank shaft 5 which is rotatively supported by a front case 4 of a housing 1A by a main bearing 6, and has a partition means 31 (labyrinth seal for example) which is provided between the main bearing and a shaft seal 28 which is provided at the outer side of the main bearing along the axial direction, and separating a space in which the shaft seal is provided from a low pressure chamber 15 of the housing to form a sealing chamber 30, and a first lubricating agent supply passage 29 which is formed in the housing and is opened to the sealing chamber for supplying a lubricating agent to the sealing chamber. A part of the highly compressed lubricating agent which is supplied the sealing chamber can be leaked to the low pressure chamber via the partition means during the operation of said compressor.

12 Claims, 5 Drawing Sheets

PRIOR ART Fig. 6
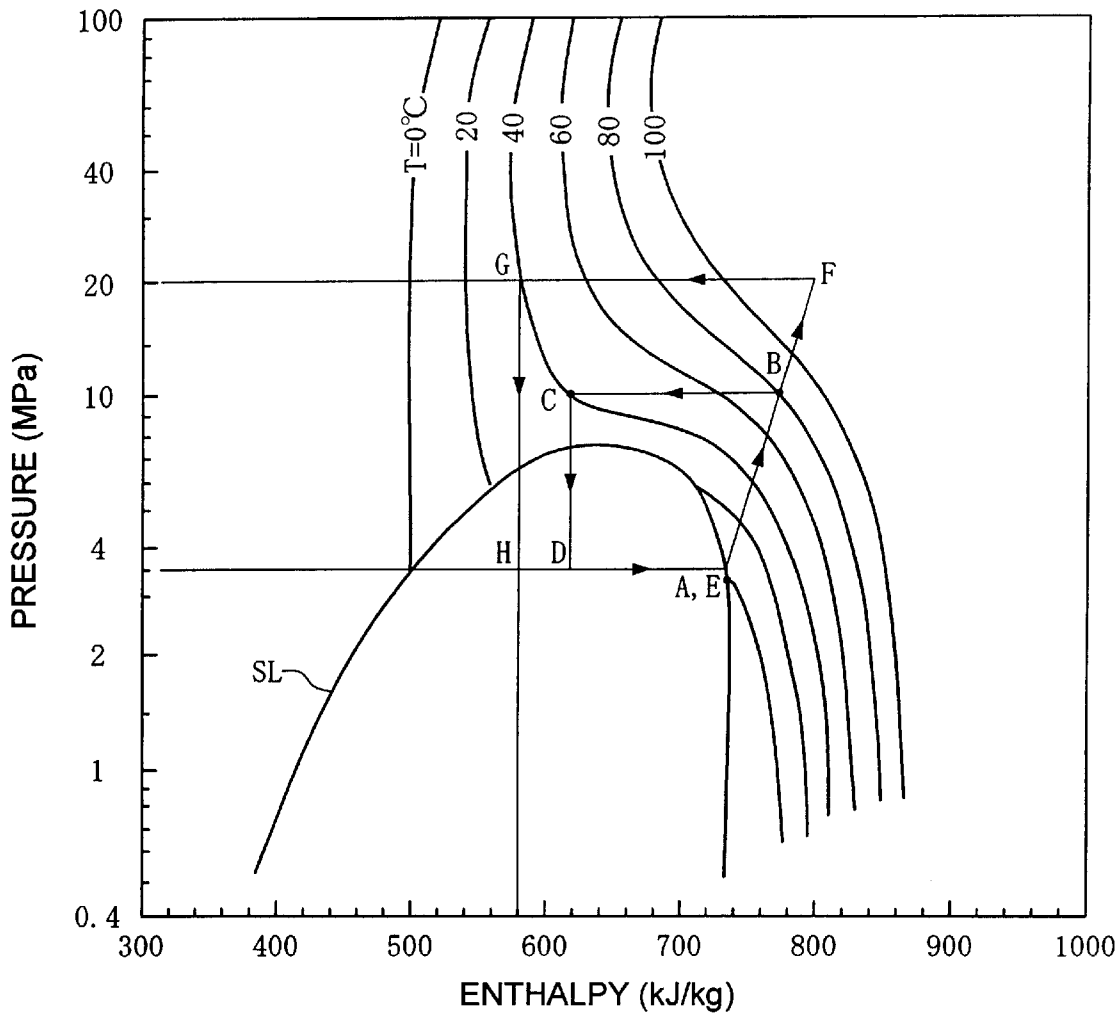

OPEN TYPE COMPRESSOR

BACKGROUND OF THE INVENTION

1. Field of the Invention

The present invention relates to an open type compressor, and especially relates to an open type compressor which is suitable for a steam compression type cooling cycle using a coolant in the supercritical area of carbon dioxide ($CO_2$) and the like.

This application is based on Japanese Patent Application No. Hei 11-1661694, the content of which is incorporated herein by reference.

2. Description of the Related Art

Recently, from the point of view of protection of the environment, a cooling cycle which uses carbon dioxide ($CO_2$) as a working gas (coolant gas) has been proposed for steam compression type cooling cycles, as a measures for elimination of fluorocarbons (refer to Japanese Patent Application, First Application No. Hei 7-18602, for example). The operation of this cooling cycle (hereinafter called $CO_2$ cycle) is similar to the conventional steam compression type cooling cycle. That is, as shown in a line A-B-C-D-A in FIG. 6 ($CO_2$ Moller diagram), gaseous $CO_2$ is compressing by a compressor (A-B), this gaseous $CO_2$ which is compressed at a high temperature is cooled by a radiator (gas cooler) (B-C), the pressure of the gas is reduced by a decompressor (C-D), the $CO_2$ which is changed to liquid phase is evaporated (D-A), and an external fluid such as air is cooled by the a latent heat of evaporation.

However, if the external temperature is high, during the sur season or the like, the temperature of the $CO_2$ at the radiator side becomes higher than the critical temperature of $CO_2$, because the critical temperature of $CO_2$ is about 31° C. which is lower than that of the fluorocarbons used as conventional coolants, and therefore, $CO_2$ does not condense at the radiator side (the line BC does not cross a saturation line SL in FIG. 6). Furthermore, the phase of $CO_2$ at the outlet side of the radiator (point C in FIG. 6) is determined by the exhaust pressure of the compressor and the $CO_2$ temperature at the outlet side of the radiator, and the $CO_2$ temperature at the outlet side of the radiator is determined by the radiation capacity of the radiator and the external temperature (which cannot be controlled). Hence, the temperature of $CO_2$ at the outlet side of the radiator is substantially uncontrollable, and the phase of the $CO_2$ at the outlet side of the radiator is controlled by the exhaust pressure of the compressor (the pressure at the outlet side of the radiator). Consequently, if the outer temperature is high during the summer season or the like, the pressure at the outlet side of the radiator must be increased as shown in line E-F-G-H-E in FIG. 6 to secure sufficient cooling capacity (difference in enthalpy), and the operation pressure of the compressor must be increased in comparison with the conventional compressor which uses fluorocarbons.

For instance, in the case of an air conditioning unit for a vehicle, the operation pressure of a compressor using $CO_2$ is increased to 40 kg/cm$^2$, as opposed to that of a conventional compressor R134 using fluorocarbon, which is 3 kg/cm$^2$. Furthermore, the stopping pressure of the compressor which using $CO_2$ is increased to 40 kg/cm$^2$, as opposed to that of R134, which is 15 kg/cm$^2$. Consequently, in the case of the $CO_2$ cycle, the differential pressure between the internal pressure of the compressor and the atmospheric pressure is increased, and therefore, there is concern of a gas leak from a shaft sealing portion of the compressor during the operation and stopping of the compressor. That is, in the conventional compressor, sufficient lubricating oil is supplied to the compressor, and this lubricating oil is partly supplied to the shaft sealing portion. However, the pressure of the lubricating oil may not be kept at a sufficiently high level, and gas leaks from the shaft sealing portion of the compressor are apt to occur. Especially, when the operation is stopped, the lubricating oil is not sufficiently supplied to the shaft sealing portion, and the gas leak fran the shaft sealing portion can easily occur. Furthermore, the shaft sealing portion may be damaged at the restart of the compressor because lubricating oil is not supplied while it is stopped. For the above reasons, the operation of the $CO_2$ cycle is not efficient and an improvement is strongly required. Besides, Japanese Patent Application, Second Publication No. Hei 3-6350 discloses a sealing apparatus for a shaft to seal a shaft-end portion of a screw type compressor. In this apparatus, a mechanical seal and a plain bearing which acts as a labyrinth seal are separately arranged on the shaft-end portion to form an enclosed chamber between the seals. A lubricating material is sent into the chamber with a pressure which is higher than the pressure in a pump chamber, and gas leakage from the pump chamber is prevented. However, this apparatus is only for preventing the gas leakage during the operation, and is not for lubricating the machine room (pump chamber) of the compressor.

The present invention is provided in compliance with the above problems of the conventional art, and the object of the present invention is to provide an open type compressor which can secure efficient and appropriate operation during the cooling cycle by improving the lubrication ability during the operation and by preventing the leakage of the working gas when the operation is stopped.

SUMMARY OF THE INVENTION

To achieve the above-described object, the open type compressor of the present invention provides the following features. That is, the open type compressor of the present invention is for compressing an introduced working gas and exhausting the working gas which is compressed by the predetermined pressure, and is characterized by comprising a crank case having a low pressure chamber in which the working gas is introduced, a crank shaft which is rotatively supported by the low pressure chamber by a bearing and compressing the working gas by rotation, a shaft seal which is provided on the crank shaft at the outer side of the bearing along the axial direction, a partition means which is provided between the bearing and the shaft seal for separating a space in which the shaft seal is provided from the low pressure chamber to form a sealing chamber, and a first lubricating agent supply passage which is formed in the crank case and is opened to the sealing chamber for supplying a lubricating agent to the sealing chamber.

In this compressor, the highly compressed lubricating agent is filled in the sealing chamber which is partitioned by the partition means via the first lubricating agent supply passage at the operation of the compressor. As a result, gas leaks from the sealing chamber is surely prevented by this highly compressed lubricating agent.

It is preferable that the partition means is an non-contact type labyrinth seal. The labyrinth seal allows the leakage of a part of the highly compressed lubricating agent which is supplied from the sealing chamber to the low pressure chamber during the operation of the compressor. In this case, the desired leak capacity is provided by a gap between two constituent members which constitute the non-contact type seal. Furthermore, because of the filling of the highly compressed lubricating agent in the sealing chamber via the first lubricating agent supply passage during the operation of the compressor, the pressure of the lubricating agent which is filled in the sealing chamber becomes sufficiently higher than that of the low pressure chamber (machine room). Therefore, a part of the lubricating agent in the sealing chamber is leaked to the low pressure chamber via the labyrinth seal and the low pressure chamber is lubricated by the leaked lubricating agent.

Meanwhile, when the operation is stopped, the pressure in the sealing chamber and the low pressure chamber becomes almost the same. Therefore, the highly compressed lubricating agent which is filled in the sealing chamber is kept by the labyrinth seal and the leakage of the lubricating agent from the sealing chamber is surely prevented by this highly compressed lubricating agent. Furthermore, damage to the shaft sealing portion during the restarting of the compressor is prevented. For the above reasons, the cooling cycle can operate efficiently.

A contact type seal which is composed of a sealing apparatus such as a mechanical seal or shaft seal and a leak passage which is formed in the sealing apparatus can also be employed as the above-described partition means. In this case, a leak capacity similar to that of the above-described labyrinth seal can be obtained by forming a leak passage which provides a predetermined leak capacity to the contact-seal which has complete seal capacity.

It is also preferable that the crank case has a second lubricating agent supply passage which is opened to the low pressure chamber for supplying the lubricating agent to the low pressure chamber. In this case, the lubricating agent is directly supplied to the low pressure chamber via this second lubricating agent supply passage during the operation.

A lubricating oil supply means for supplying lubricating oil as a lubricating agent to the sealing chamber can also be provided. The lubricating oil supply means comprises an oil separator which is provided at an exhaust pipe of the highly compressed working gas for separating said lubricating oil from the working gas, and an oil return pipe for returning the lubricating oil which is separated by the oil separator to the first lubricating agent supply passage or first and second lubricating agent supply passages. In this case, the lubricating oil which is separated from the exhausted working gas by the lubricating oil supply means and introduced to the sealing chamber or sealing chamber and low pressure chamber and is reused as the lubricating oil, and therefore, the running cost of the compressor is reduced.

Furthermore, the present invention is particularly effective for use in an open type compressor for a cooling cycle which uses carbon dioxide as the working gas in which the operation pressure is high and the working gas can easily be leaked.

BRIEF EXPLANATION OF THE DRAWINGS

FIG. 6 is a Mollier diagram for $CO_2$.

DESCRIPTION OF THE PREFERRED EMBODIMENTS

Preferred embodiments of the open type compressor of the present invention will be explained with reference to the Figures.

Figure 5:
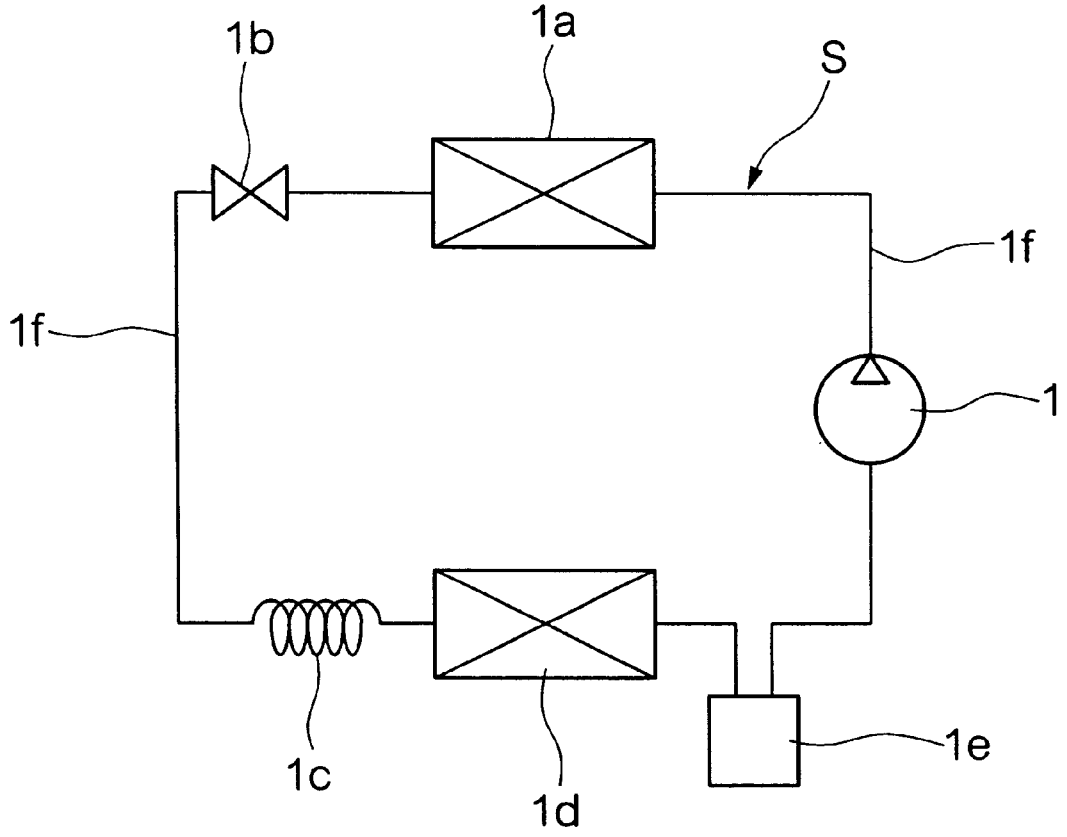
FIG. 5 is a schematic view of the steam compression type cooling cycle.

First, a $CO_2$ cycle having the open type compressor of the present invention will be explained with reference to FIG. 5. This $CO_2$ cycle S is used for the air conditioning unit for a vehicle and reference number 1 denotes the open type compressor which compresses gaseous $CO_2$. The open type compressor 1 is driven by a driving force which is supplied by a driving source, not shown (for example an engine or the like). Reference number 1*a* denotes a radiator (gas cooler) for cooling the $CO_2$ which is compressed by the open type compressor, by means of heat-exchange between the $CO_2$ and an external air; reference number 1*b* denotes a pressure regulation valve for regulating the pressure at the outlet side of the radiator 1*a* in compliance with the $CO_2$ temperature at the outlet side of the radiator 1*a*. The $CO_2$ which is decompressed by the pressure regulation valve 1b and a reducer 1*c* to forms 2 phases, gas and liquid, with low temperature and low pressure. Reference number 1*d* denotes an evaporator (heat absorber) which acts as a cooling means of the air in a passenger compartment, and the $CO_2$ which forms 2 phases of gas and liquid cools the air of inside the passenger compartment by taking the latent of vaporization (evaporation) of the $CO_2$ from the inside air, in the evaporator 1*d*. Reference number 1*e* denotes an accumulator for temporarily accumulating the liquid phased $CO_2$. Furthermore, the open type compressor 1, radiator 1*a*, pressure regulation valve 1*b*, reducer 1*c*, evaporator 1*d* and accumulator 1*e* are connected by an oil exhaust pipe 1*f* and form a closed circuit.

Figure 1:
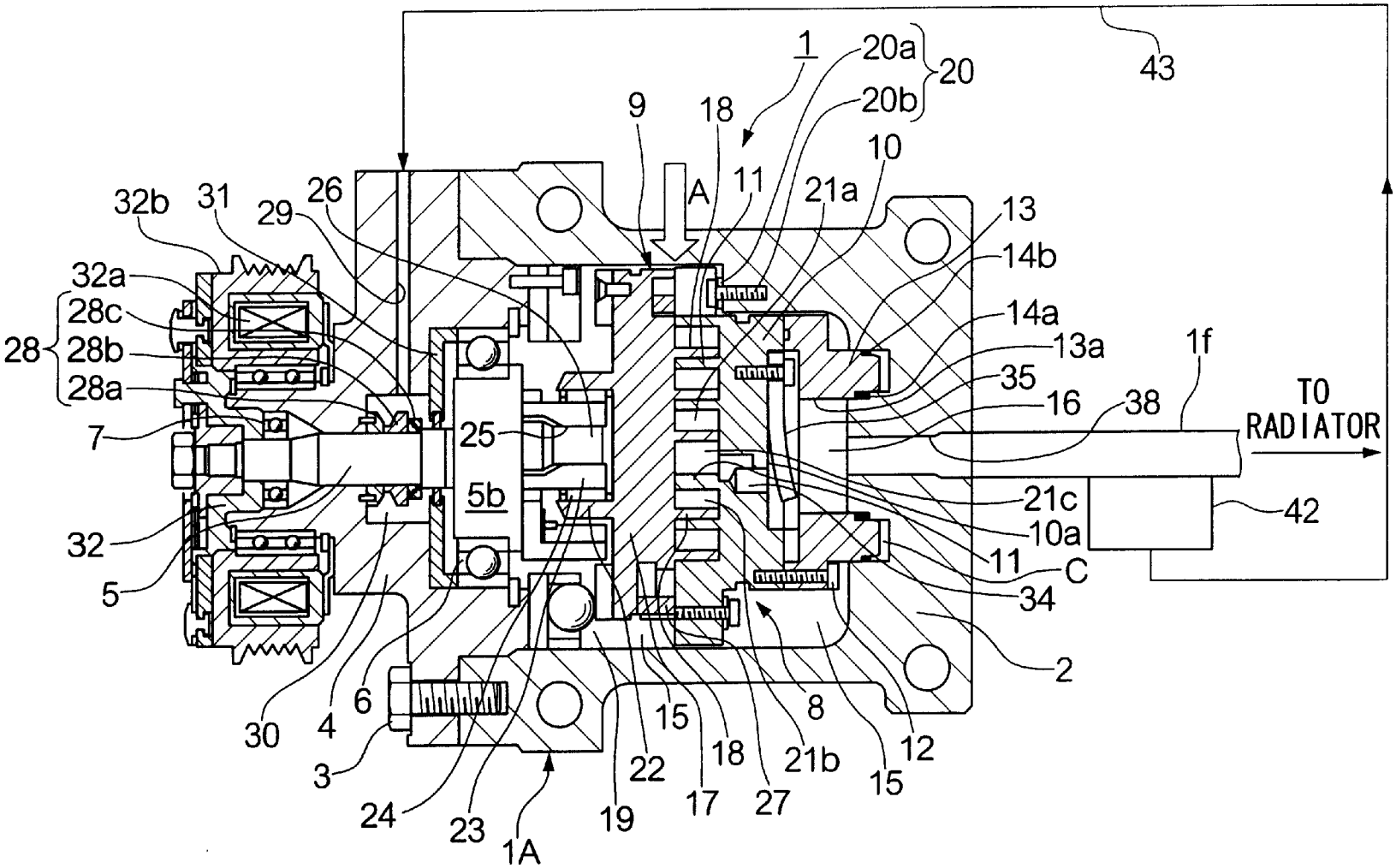
FIG. 1 is a longitudinal cross sectional view of an embodiment of the open type compressor of the present invention.

Next, an embodiment of the open type compressor 1 will be explained with reference to FIG. 1 and FIG. 2 (a cross sectional view of the vicinity of the sealing chamber of FIG. 1).

A housing (casing) 1A of the open type compressor 1 is composed of a case main body 2 which has a cup shape, and a front case (crank case) 4 which is fastened the case main body 2 by a bolt 3. A crank shaft 5 penetrates the front case 4 and is rotatively supported in the front case 4 via a main bearing 6 and a sub bearing 7, and rotation of an automotive engine (not shown) is transmitted to the crank shaft via a known electromagnetic clutch 32. Furthermore, reference numbers 32*a*, 32*b* denote a coil and a pulley of the electromagnetic clutch 32 respectively.

A fixed scroll 8 and revolving scroll 9 are provided in the housing 1A. The fixed scroll 8 has an end plate 10 and a spiral projection (lap) 11 which is projected from the inner surface of the end plate 10, and a backing block 13 is detachably fastened to the case main body 2 by a bolt 12. Furthermore, O-rings 14*a*, 14*b* are provided on inner and outer surfaces of the backing block 13 respectively. These O-rings 14*a*, 14*b* are closely contacted with the inner surface of the case main body 2, and therefore, a low pressure chamber (intake chamber) 15 which is formed in the case main body 2 and a high pressure chamber (exhaust chamber) 16 which is explained later are isolated. The high pressure chamber 16 is composed of an inner space 13*a* of the backing block 13 and a hollow portion 10*a* which is formed on the back surface of the end plate 10.

The revolving scroll 9 comprises an end plate 17 and a spiral projection (lap) 18 which extends from the inner surface of the end plate 17. This spiral projection 18 has substantially the same shape as the spiral projection 11 of the above-described fixed scroll 8.

Figure 4:
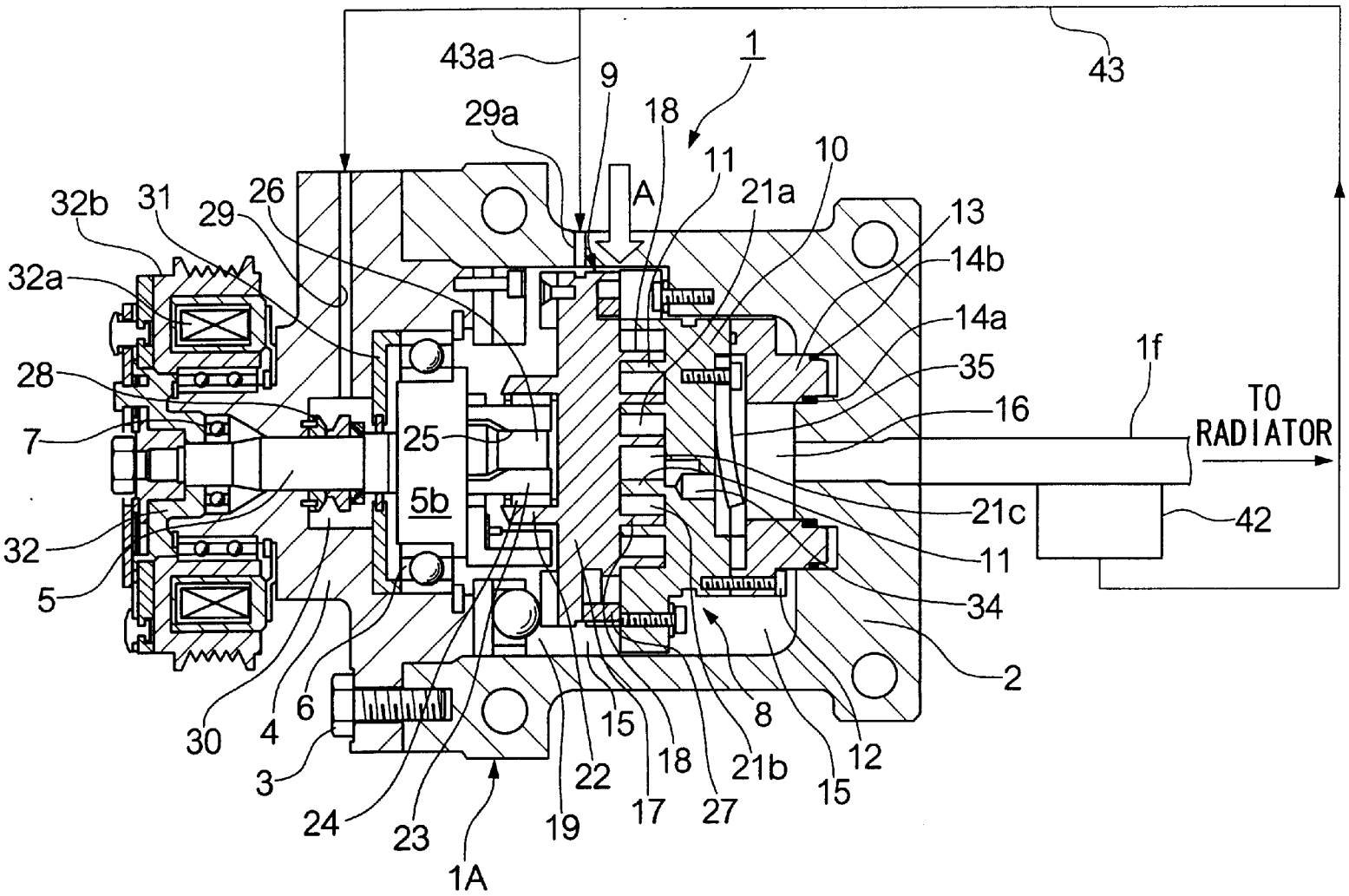
FIG. 4 is a longitudinal cross sectional view of another embodiment of the open type compressor of the present invention.

A ring shaped plate spring 20*a* is installed between the fixed scroll 8 and the front case 4. This plate spring 20*a* is mutually fastened to the fixed scroll 8 and the front case 4 along the circumferential direction by a plurality of bolts 20*b*. As a result, the fixed scroll 8 can only move along the axial direction within the limit of the maximum bending amount of the plate spring 20*a* (floating structure). Furthermore, a fixed scroll supporting member 20 is composed by the ring shaped plate spring 20*a* and the bolts 20*b*. Besides, a space c is formed between the projecting portion which projects from the back surface of the backing block 13 and the housing 1A, and the backing block 13 can be moved in the space C along the before-mentioned axial direction with the fixed scroll 8. The axes of fixed and revolving scrolls 8, 9 are eccentrically separated from each other at the distance of a radius of their revolution. The phase of these scrolls 8, 9 differs by 180°, and these scrolls 8, 9 are engaged with each other as shown in FIG. 4. A tip seal (not shown) is laid on the end surface of the spiral projection 11 and is closely contacted to the inner surface of the end plate 17, and another tip seal (not shown) is laid on the end surface of the spiral projection 18 and is closely contacted to the inner surface of the end plate 10. Furthermore, the side surfaces of these spiral projections 11, 18 are closely contacted to each other at several places. If tip seals are not installed on the spiral projections 11, 18, the end surfaces of the spiral projections 11, 18 are respectively closely contacted to the inner surfaces of the end plates 10, 17. Because of the above described structures, a plurality of closed spaces 21*a*, 21*b*are formed with point symmetry about the center of the spiral. In addition, a rotation prevention ring (Oldham ring) 27 for preventing rotation of the revolving scroll 9 but allowing revolution thereof is provided between the fixed scroll 8 and the revolving scroll 9.

A cylindrical shaped boss 22 is formed on the central part of the outer surface of the end plate 17, and a drive bush 23 is rotatively installed in the inside of the boss 22 via a revolving bearing (drive bearing) 24 which also acts as a radial bearing. A penetrating hole 25 is bored the drive bush 23, and an eccentric shaft 26 which projects from the inner in surface of the crank shaft 5 is rotatively installed in the penetrating hole 25. Furthermore, a thrust ball bearing 19 for supporting the revolving scroll 9 is placed between the outer circumferential end of the outer surface of the end plate 17 and the front case 4.

On the outer circumferential surface of the crank shaft 5, a known mechanical seal (shaft seal) 28 which is explained later is provided at the outer side of the main bearing 6. Furthermore, a lubricating oil supply passage (first lubricating agent supply passage) 29 is bored in the front case 4, and one end of this passage 29 is opened to the sealing chamber (oil chamber) 30, described later, which is formed at the inside of the front case 4. The sealing chamber 30 is isolated from the low pressure chamber 15 by non-contact type labyrinth seal (partition means) 31 which is explained later. In this case, the partition means is not limited to the labyrinth seal 31, and a contact-seal which is composed by forming a leak passage to a sealing apparatus such as a mechanical seal or shaft seal can be employed as explained later. A highly compressed lubricating oil (lubricating agent) is supplied via the lubricating oil supply passage 29. That is, an oil separator 42 for separating the lubricating oil from the working gas is prepared the pipe 1*f* for the highly compressed working gas which is exhausted from an exhaust opening 38, and the lubricating gas which is gathered by the oil separator 42 is introduced into the lubricating oil supply passage 29 via an oil return pipe 43.

Here, the area near the sealing chamber 30 will be explained with reference to FIG. 2.

A slide ring type shaft seal apparatus is employed as the mechanical seal 28 of the present embodiment, for example. This mechanical seal 28 has a seat ring (rubber packing) 28*a* which is formed by a synthetic rubber, for example, and a driven ring (slide ring) 28*b* which rotates with the crank shaft 5 and is formed of a carbon steel for example. The driven ring 28*b* is closely contacted with the seat ring 28*a* by a pusher 28*c*, and therefore, the driven ring 28*b* slides toward the seat ring 28*a* in compliance with the rotation of the crank shaft 5. This mechanical seal is disclosed in Japanese Utility Model Application, Second Publication No. Hei 4-33424 which was filed by the applicant of the present application, and in "Revised Refrigerating Engineering" (Published in Japan by Corona Co., Publication date: Jul. 20, 1975) pp. 141–148, for example.

The partition means 31 of the present invention (the non-contact type labyrinth seal is employed in the present embodiment) is composed of a ring shaped seal main body (constituent member) 31*a* and a ring shaped tip (constituent member) 31*b* which is movably engaged with the inner circumferential surface of the seal main body 31*a*. A slight gap is formed between the outer circumferential surface of the tip 31*b* and the inner circumferential surface of the seal main body 31*a*, and therefore, these members 31*a*, 31*b* are separated and the highly compressed lubricating oil can pass through the gap. The outer circumferential portion of the seal main body 31*a* forms a thick portion 40 and the thick portion 40 is pressed against the inner surface of the front case 4 by an outer ring 6*a* of the main bearing 6, and therefore, the thick portion 40 is supported by the front case 4. Furthermore, the main bearing 6 is pressed along the left side of the FIG. 2 by a brim portion 5*a* of the crank shaft 5, and therefore, the seal main body 31*a* is fixed to the front case 4. In addition, the tip 31*b* is formed by an elastic material and the crank shaft is pressed by the inner circumferential surface of the tip 31*b*. Because of the above described structure, the sealing chamber 30 is isolated from the low pressure chamber 15 by the labyrinth seal 31. The labyrinth seal 31 has the feature that the tip 31*b* is elastically deformed by the highly compressed lubricating oil which is supplied by the sealing chamber 30 to leak a part of it to the low pressure chamber 15 through the above-described gap.

Next, the movement of the open type compressor 1 will be explained.

When applying an electric power to the coil 32*a* of the electromagnetic clutch 32, rotation of the automotive engine is transmitted to the crank shaft 5, and the rotation of the crank shaft 5 is transmitted to the revolving scroll 9 via a rotation drive mechanism which is composed of the eccentric shaft 26, penetrating hole 25, drive bush 23, revolving bearing 24, and the boss 22. Consequently, the revolving scroll 9 revolves on a circular orbit, and the rotation of the revolving scroll 9 is prevented by the rotation prevention ring 27.

When the revolving scroll 9 revolves, the line contact portions between the spiral projections 11, 18 gradually moves to the center of the spiral, and the closed spaces (compression chamber) 21*a*, 21*b* are gradually moved to the center of the spiral while their volumes thereof are gradually reduced. In compliance with these movements, the working gas which flows into the intake chamber 15 (refer to arrow A in FIG. 1) via an inlet (not shown) flows into the closed spaces (compression chambers) 21*a*, 21*b* from an opening which is formed at the outer end of the spiral projections 11, 18. This working gas is compressed and arrives at the center portion 21*c* of the spiral, and is exhausted to an exhaust port 34 which is bored into the end plate 10 of the fixed scroll 8. The exhausted working gas pushes up the exhaust valve 35 and arrives at the high pressure chamber 16, and is exhausted from the exhaust opening 38. As described above, the working gas which flows into the intake chamber 15 is compressed in the closed space 21*a*, 21*b* by the revolving of the revolving scroll 9, and is exhausted as a compressed gas.

Besides, the lubricating gas which is gathered by the oil separator 42 is supplied to the sealing chamber via the lubricating oil supply passage 29 and oil return pipe 43. Therefore, the pressure of the lubricating oil which is filled in the sealing chamber 30 becomes sufficiently higher than that of the low pressure chamber 15 (machine room) in the housing 1A. Consequently, the tip 31*b* of the labyrinth seal 31 is elastically deformed and a part of the highly compressed lubricating oil is leaked to the low pressure chamber 15. As a result, gas leakage from the shaft sealing 28 is prevented by the highly compressed lubricating oil which is filled in the sealing chamber 30. Furthermore, the low pressure chamber 15 is lubricated by the leaked lubricating oil.

When stopping the transmission of the rotation to the crank shaft 5 by stopping the application of electric power to the coil 32*a* of the electromagnetic clutch 32, the operation of the open type compressor 1 is stopped and the pressure in the sealing chamber 30 and the low pressure chamber 15 become almost the same. Therefore, the tip 31*b* of the labyrinth seal 31 is not deformed and the highly compressed lubricating oil which is filled in the sealing chamber 30 is kept by the labyrinth seal 31. As a result, gas leaks from the sealing chamber 30 and from the shaft sealing 28 are surely prevented.

Another embodiment of the partition means will be explained below.

Figure 2:
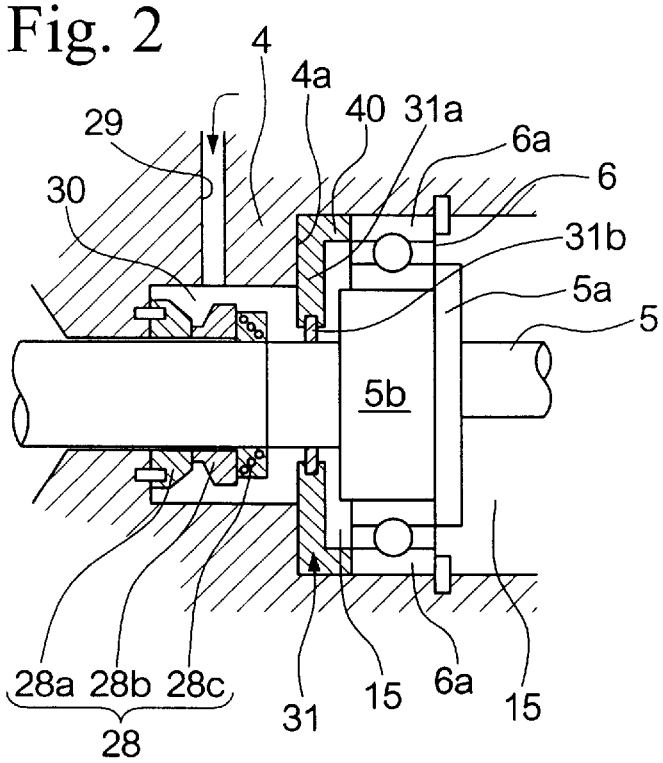
FIG. 2 is an enlarged cross sectional view of the vicinity of the sealing chamber of FIG. 1.
Figure 3:
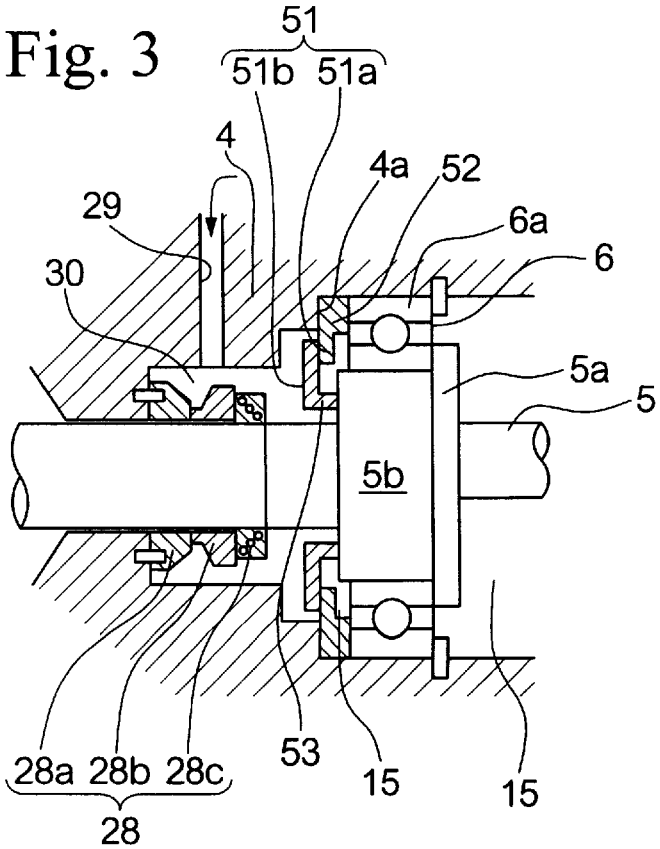
FIG. 3 is an enlarged cross sectional view of the vicinity of the another embodiment of the sealing chamber.

As shown in FIG. 3, a labyrinth seal 51 which functions as the partition means is composed of a ring shaped first sealing portion (constituent member) 51*a* which is fixed to the front case 4 and a ring shaped second sealing portion (constituent member) 51*b* which is fixed the crank shaft 5. The outer circumferential portion of the first sealing portion 51*a* forms a thick portion 52 and the thick portion 52 is pressed against the inner surface of the front case 4 by an outer ring 6*a* of the main bearing 6, and therefore, the first sealing portion 51*a* is fixed to the front case 4. Furthermore, the inner circumferential portion of the second sealing portion 51*b* forms a thick portion 53 and the thick portion 53 is fixed to the end surface of a large diameter portion 5*b* of the crank shaft 5. A slight gap is formed between the inner circumferential surface of the first sealing portion 51*a* and the outer circumferential surface of the second sealing portion 51*b*, and therefore, these sealing portions 51*a*, 51*b* are not contacted with each other. Because of the above described construction, the sealing chamber 30 is isolated from the low pressure chamber 15 by the labyrinth seal 51. During the operation of the compressor, a part of the highly compressed lubricating oil which is supplied to the sealing chamber 30 is leaked to the low pressure chamber 15 through the above-described gap. The rest of the construction of this embodiment is same as that of the embodiment shown in FIG. 2.

In the embodiments which shown in FIGS. 2 and 3, the labyrinth seal is employed as the partition means, however, the partition means is not limited to the labyrinth seal, and a contact-seal which is composed by forming a leak passage in the sealing apparatus such as the mechanical seal or the shaft seal can be employed. That is, a leakage capacity similar to that of the above-described labyrinth seal can be obtained by forming a leak passage which has a predetermined leakage capacity in the contact-seal which can form a complete seal.

Next, another embodiment of the open type compressor of the present invention will be explained.

In this embodiment, as shown in FIG. 4, a lubricating oil supply passage (second lubricating agent supply passage) 29*a* which is opened into the low pressure chamber 15 is bored in the case main body 2, and a branch pipe 43*a* from the oil return pipe 43 is connected to the lubricating oil supply passage 29*a*. During the operation of the compressor, the lubricating oil is directly supplied to the low pressure chamber 15 and the capacity to lubricate the low pressure chamber 15 is improved.

Furthermore, in these embodiments, the open type compressor is applied for a $CO_2$ cycle which uses $CO_2$ as the working gas, however, the present invention is not limited to the above embodiments. That is, the open type compressor of the present invention also can be applied to a normal type steam compression type cooling cycle which uses fluorocarbons as the working gas, for example.

In addition, in these embodiments, the lubricating oil which is separated from the exhausted working gas at a high pressure is introduced into the sealing chamber (or sealing chamber and low pressure chamber) and reused for reduction of the running costs, however, the present invention is not limited to the above embodiment. That is, a tank which stores the lubricating oil and supplies highly compressed lubricating oil to the sealing chamber (or sealing chamber and low pressure chamber) can be separately provided, for example.

What is claimed is:

1. An open type compressor for compressing an introduced working gas and exhausting said working gas which is compressed to a predetermined pressure, the open type compressor comprising:

a crank case having a low pressure chamber in which said working gas is introduced, a crank shaft which is rotatively supported by said low pressure chamber by a bearing and compressing said working gas by rotation, a shaft seal which is provided on said crank shaft at the outer side of said bearing along the axial direction, a partition means which is provided between said bearing and said shaft seal for separating a space in which said shaft seal is provided from said low pressure chamber to form a sealing chamber, and a first lubricating agent supply passage which is formed in said crank case and is opened to said sealing chamber for supplying a lubricating agent to said sealing chamber.

2. An open type compressor according to claim 1, wherein said partition means is an non-contact type labyrinth seal, and said labyrinth seal allows leakage a part of said lubricating agent which highly compressed, and is supplied from said sealing chamber to said low pressure chamber during the operation of said compressor.

3. An open type compressor according to claim 1, wherein said partition means is a contact type seal which is composed of a sealing apparatus such as a mechanical seal or an shaft seal and a leak passage which is formed in said sealing apparatus.

4. An open type compressor according to one of claims 1 to 3, wherein said crank case has a second lubricating agent supply passage which is opened to said low pressure chamber for supplying said lubricating agent to said low pressure chamber.

5. An open type compressor according to one of claims 1 to 3, wherein a lubricating oil supply means for supplying a lubricating oil as said lubricating agent to said sealing chamber is provided;

said lubricating oil supply means comprising:

an oil separator which is provided at an exhaust pipe of said highly compressed working gas for separating said lubricating oil from said working gas, and an oil return pipe for returning said lubricating oil which is separated by said oil separator to said first lubricating agent supply passage.

6. An open type compressor according to claim 4, wherein a lubricating oil supply means for supplying a lubricating oil as said lubricating agent to said sealing chamber and said low pressure chamber, is provided;

said lubricating oil supply means comprising:

an oil separator which is provided at an exhaust pipe of said highly compressed working gas for separating said lubricating oil from said working gas, and an oil return pipe for returning said lubricating oil which is separated by said oil separator to said first lubricating agent supply passage and said second lubricating agent supply passage.

7. An open type compressor according to claim 1, wherein said working gas is carbon dioxide.

8. An open type compressor according to claim 2, wherein said working gas is carbon dioxide.

9. An open type compressor according to claim 3, wherein said working gas is carbon dioxide.

10. An open type compressor according to claim 4, wherein said working gas is carbon dioxide.

11. An open type compressor according to claim 5, wherein said working gas is carbon dioxide.

12. An open type compressor according to claim 6, wherein said working gas is carbon dioxide.

* * * * *